US006102507A

United States Patent [19]

Yoshida

[11] Patent Number: 6,102,507

[45] Date of Patent: Aug. 15, 2000

[54] INK JET OUTPUT APPARATUS

[75] Inventor: Hitoshi Yoshida, Kounan, Japan

[73] Assignee: Brother Kogyo Kabushiki Kaisha, Nagoya, Japan

[21] Appl. No.: 08/766,763

[22] Filed: Dec. 13, 1996

[30] Foreign Application Priority Data

Dec. 18, 1995 [JP] Japan ..... 7-348674

[51] Int. Cl.[7] ..... B41J 29/38

[52] U.S. Cl. ..... 347/6

[58] Field of Search ..... 347/6, 17, 16, 347/7, 102

[56] References Cited

U.S. PATENT DOCUMENTS

| | | | |
|---|---|---|---|
| 4,521,789 | 6/1985 | Jinnai | 347/6 |
| 4,617,580 | 10/1986 | Miyakawa | 347/16 |
| 5,302,971 | 4/1994 | Ohba et al. | 347/6 |
| 5,323,176 | 6/1994 | Sugiura et al. | 347/102 |
| 5,477,246 | 12/1995 | Hirabayashi et al. . | |

FOREIGN PATENT DOCUMENTS 6-226963 8/1994 Japan .

*Primary Examiner*—John Barlow
*Assistant Examiner*—Charles W. Stewart, Jr.
*Attorney, Agent, or Firm*—Oliff & Berridge, PLC

[57] ABSTRACT

An ink jet output apparatus for performing recording operation by ejecting ink from a nozzle section onto a material to be recorded, comprises an input system for setting a type of the material to be recorded, a memory system for storing an optimum viscosity and an optimum droplet amount of the ink to be ejected onto the recording material according to types of materials to be recorded, a control system for regulating the viscosity of the ink to be ejected onto the recording material into an optimum viscosity stored in the memory system in accordance with the material type set in the material type input system, and a regulation system for regulating an amount of an ink droplet to be ejected in accordance with the material type set in the material type input system into an optimum droplet amount stored in the memory system.

16 Claims, 3 Drawing Sheets

FIG. 3

TABLE 1

| | INK TEMPERATURE (°C) | DRIVING VOLTAGE (V) |
|---|---|---|
| COATED PAPER (MADE BY COMPANY A) | 145 | 15 |
| COATED PAPER (MADE BY COMPANY B) | 140 | 20 |
| COPY PAPER (MADE BY COMPANY C) | 140 | 20 |
| TRACING PAPER (MADE BY COMPANY D) | 130 | 30 |
| OHP SHEET (MADE BY COMPANY E) | 155 | 20 |
| CLOTH (KIND F) | 90 | 130 |
| CLOTH (KIND G) | 80 | 150 |

INK JET OUTPUT APPARATUS

BACKGROUND OF THE INVENTION

1. Field of the Invention

The present invention relates to an ink jet output apparatus for performing recording operation by ejecting ink from nozzles onto a material to be recorded, and, more particularly to an ink jet output apparatus capable of controlling the viscosity and amount of the ink to be ejected on a material into optimum values respectively according to the type of the material to be recorded, thereby enabling to perform recording operation with constant recording quality without regard to the types of materials to be recorded.

2. Description of Related Art

In an ink jet output apparatus, generally, ink droplets are ejected from nozzles onto a material to be recorded such as a paper and the like, and is adhered to form dots which in total represent a desired figure, thereby recording various images, i.e., characters and marks on the material. The ink adhered on the material to be recorded tends to more or less spread and be blurred thereon. The degree of the ink spread has an influence on the density and resolving power of print characters and the like. The degree of the ink blur varies with types of materials to be recorded, ink viscosity, and an amount of an ink droplet.

Accordingly, the ink jet output apparatus, taking coated paper applied with a special coat to regulate ink absorbency as a standard for a material to be recorded, determines driving conditions for ejecting ink, i.e., ink temperature to perform an ink ejection at an optimum viscosity of ink and an optimum amount of an ink droplet, thereby enabling to provide high recording quality.

For example, there is provided an ink jet recording apparatus described in Japanese Patent Application laid-open No. 5-57904, from which U.S. Pat. No. 5,477,246 claims a part of priority, which controls ink temperature to change according to the types of the materials to be recorded. This apparatus has a purpose of performing a print operation on materials except for a coated paper, e.g., a copy sheet, an OHP sheet, and the like, and therefore utilizes the property of ink that the amount of an ink droplet is influenced by the temperature of the ink.

There is also proposed an ink jet printer described in Japanese Patent Application laid-open No. 6-226963, which controls the amount of an ink droplet to change according to a change in types of materials to be recorded.

In the ink jet output apparatus in the prior art, however, as a change in types of materials to be recorded, it only considers a difference in brands of coated papers, and a difference among copy sheet, regular paper, and at most OHP sheet in addition to coated sheet. These sheets only cause slightly blur. Therefore, when used is a material to be recorded such as cloth which easily causes blur than the above materials it results in performing the recording operation with low recording quality. It is conceivable to extremely reduce the amount of droplet can be supposed to prevent ink blur, but it results in unsatisfactory density because of a decrease in the amount of ink. Consequently, it is impossible to easily print desired images on handkerchiefs, T-shirts, and the like, instead of doing embroidery thereon.

SUMMARY OF THE INVENTION

The present invention has been made in view of the above circumstances and has an object to overcome the above problems and to provide an ink jet output apparatus capable of controlling the viscosity and the amount of an ink droplet to be ejected to be optimum values according to the types of materials to be recorded, thereby performing print operation with constant recording quality without regard to types of materials to be recorded.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet output apparatus of this invention, for performing recording operation by ejecting ink from a nozzle section onto various types of materials to be recorded, comprises input means for setting a type of the material to be recorded, memory means for storing an optimum viscosity and an optimum droplet amount of the ink to be ejected onto the recording material according to types of materials to be recorded, control means for regulating the viscosity of the ink to be ejected onto the recording material into the optimum viscosity stored in the memory means in accordance with the type of material set by the material type input means, and regulation means for regulating an amount of the ink droplet to be ejected in accordance with the type of material set by the material type input means into the optimum droplet amount stored in the memory means.

In the above ink jet output apparatus, at first, the type of a material to be recorded is input by the material type input means. This input operation may be performed with a switch and the like by an operator. Alternatively, a sensor may be provided in the ink jet output apparatus to automatically discriminate a type of a material to be recorded. Based on the material type set by the material type input means, the viscosity control means regulates the current ink viscosity into an optimum viscosity stored in the memory means, and the droplet amount regulation means regulates an amount of an ink droplet into an optimum amount stored in the memory means. Accordingly, in the recording operation on a material to be recorded, the ink is ejected from a nozzle section at the optimum ink viscosity and the optimum ink droplet amount suitable for the type of the material and is fixed on the material to be recorded, so that it can obtain high recording quality.

Regulating the viscosity of ink by the viscosity control means is performed specifically by regulating a temperature of the ink.

According to the present invention, there is also provided an ink jet output apparatus, as described in claim 2, in which the viscosity control means regulates the viscosity of the ink into the optimum viscosity higher than that in a case of regular paper when the type of material set by the material type input means is cloth.

In the ink jet output apparatus, when the material type set by the material type input means is cloth, the ink is regulated to have the optimum viscosity higher than that for regular paper by an viscosity control means. This is because in general cloth easily causes ink blur as compared with paper. Accordingly, when the ink regulated to have high viscosity is adhered on the cloth, it prevents ink blur, thus proving high recording quality. In claim 2, regular paper indicates common coated paper used as materials to be recorded for an ink jet output apparatus.

In the ink jet output apparatus according to the present invention, as described in claim 3, the viscosity control means regulates the viscosity of the ink into an optimum viscosity lower than that in a case of regular paper when the type of material set by the material type input means is OHP sheet.

In the above ink jet output apparatus, when the material type set by the material type input means is OHP sheet, the ink is regulated to have an optimum viscosity lower than that for regular paper. This is because OHP sheet has extremely inferior ink penetration characteristics as compared with paper. Accordingly, the ink regulated to have a low viscosity is adhered onto the OHP sheet; therefore, it can prevent the ink adhered from becoming thick like a dome at an adhering position. In this way, it is possible to control the thickness of the adhered ink to be thin and to provide good coloring at projecting OHP sheets accordingly. The ink adhered can also dry fast. In claim 3, regular paper indicates common coated paper as well as in claim 2.

According to the present invention, there is also provided the ink jet output apparatus, as described in claim 4, in which the viscosity control means comprises means for heating ink and controls the heating means to change a temperature of the ink in accordance with the type of material set by the material type input means, thereby to regulate the viscosity of the ink into the optimum viscosity.

In this ink jet output apparatus, the viscosity control means controls the driving of the heating means according to the material type set by the material type input means in order to change the temperature of the ink. With the change in temperature of the ink, the viscosity of the ink is regulated into an optimum value stored in the memory means.

According to the present invention, there is also provided the ink jet output apparatus, as described in claim 5, in which the heating means causes a change in temperature of the ink at least existing in the nozzle section.

In this way, the heating means causes a change in temperature of the ink in the nozzle section, thus regulating the temperature of the ink to be ejected from the nozzle section, i.e., that of the ink to be adhered on a recording material so that the ink has an optimum viscosity suitable for the type of the material. This can provide high recording quality.

According to the present invention, there is also provided the ink jet output apparatus, as described in claim 6, in which the droplet amount regulation means regulates the amount of the ink droplet into the optimum droplet amount less than that in a case of regular paper when the type of material set by the material type input means is cloth.

In this ink jet output apparatus, when the material type set by the material type input means is cloth, the droplet amount regulation means regulates the amount of an ink droplet into an optimum amount less than the optimum value for regular paper. This is because cloth has the property of easily causing blur as compared with paper. For the reason, the ink droplets each having a small amount are allowed to adhere on the cloth, so that it can prevent ink blur and obtain high recording quality.

According to the present invention, there is also provided the ink jet output apparatus, as described in claim 7, in which the droplet amount regulation means regulates the amount of the ink droplet into an optimum amount greater than that in a case of regular paper when the type of material set by the material type input means is OHP sheet.

In this ink jet output apparatus, when the material type set by the material type input means is OHP sheet, the droplet amount regulation means regulates the amount of an ink droplet into an optimum amount larger than the optimum value for regular paper. This is because OHP sheet has the property of causing little ink blur as compared with paper. For the reason, the ink droplets each having a large amount are allowed to adhere on the OHP sheet, so that the diameter of an ink dot at an adhered portion is kept sufficiently, producing adequate ink print density. Regular paper in claim 6 indicates common coated paper as well as in claims 2 and 3.

According to the present invention, there is also provided the ink jet output apparatus, as described in claim 8, further comprises a head unit having an ink chamber being filled with ink and communicated with the nozzle section, and an energy generating element for applying ejection pressure to the ink in the ink chamber in response to a driving pulse applied thereto, wherein the droplet amount regulation means regulates the amount of the ink droplet into the optimum amount by changing the driving pulse to be applied to the energy generating element.

In the ink jet output apparatus, the droplet amount regulation means changes a driving pulse to be applied to the energy generating element in accordance of the type of material set by the material type input means. Accordingly, in the head system, the driving pulse corresponding to the type of the material to be recorded is applied to the energy generating element, thus applying a proper ejecting pressure to the ink existing in the ink chamber. In this way, the apparatus can eject ink at the optimum amount of the ink droplet according to the type of the material to be recorded, making it possible to perform recording operation with high quality.

In the ink jet output apparatus according to the present invention, as described in claim 9, the droplet amount regulation means regulates the amount of the ink droplet into the optimum amount by changing a voltage value of the driving pulse.

In this ink jet output apparatus, the droplet amount regulation means changes the voltage value of the driving pulse in accordance with the type of material set by the material type input means, so that in the head system, the driving pulse with the voltage value suitable for the type of the material is applied to the energy generating element, causing the ejection of ink droplets at the optimum amount of the ink droplet.

Concretely, in the above ink jet output apparatuses, the viscosity control means regulates the viscosity of the ink into the optimum viscosity by heating the ink through the heating means so that the temperature thereof is retained at a temperature lower than 100° C., when the type of material set by the material type input means is the cloth, and the optimum viscosity lies near 80 cP when the temperature is retained at the temperature lower than 100° C.

The viscosity control means regulates the viscosity of the ink into the optimum viscosity by heating the ink through the heating means so that the temperature thereof is retained at a temperature higher than 150° C., when the type of material set by the material type input means is the OHP sheet, and the optimum viscosity lies within a range of 1–20 cP when the temperature is retained at the temperature higher than 150° C.

Furthermore, the amount of the ink droplet becomes the optimum amount when the voltage value of the driving pulse is regulated so as to exceed 130 V, in case that the type of material input by the material type input means is cloth.

Alternatively, the amount of the ink droplet becomes the optimum amount when the voltage value of the driving pulse is regulated so as to lie near 20 V, in case that the type of material input by the material type input means is OHP sheet.

As described above, according to claim 1 of the present invention, in which the viscosity and the amount of an ink droplet are regulated to be the optimum values according to the types of materials to be recorded, it is therefore possible to provide an ink jet output apparatus capable of performing the recording operation with constant recording quality irrespective of the types of materials to be recorded.

According to claim 2, the viscosity of ink is controlled to increase in a case of the recording operation on cloth, making it possible to record with little blur of ink.

According to claim 3, the viscosity of ink is controlled to decrease in a case of the recording operation on OHP sheet, making it possible to satisfactorily record.

According to claim 4, the viscosity control means controls the heating means to heat the ink to change the temperature thereof, so that it is possible to regulate the viscosity of ink into the optimum value according to the type of the material to be recorded.

According to claim 5, the ink at least existing around the nozzle section is regulated into an optimum temperature, causing the ejection of ink with the optimum viscosity from the nozzle section.

According to claim 6, the amount of ink droplet is regulated to decrease for the recording operation on cloth, so that it can perform the recording operation on the cloth with good print quality.

According to claim 7, the amount of ink droplet is regulated to increase for the recording operation on OHP sheet, so that it enables to perform sufficient recording operation on the OHP sheet.

According to claim 8, the droplet amount regulation means applies the driving pulse according to the types of materials to be recorded to the energy generating element of the head system, so that the droplet amount of the ejected ink is suitable for the type of the material. This can produce good recording quality without regard to the types of materials to be recorded.

According to claim 9, the droplet amount regulation means regulates to change the voltage value of the driving pulse, enabling to eject the ink at the droplet amount suitable for the type of a material to be recorded.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 3 is a table showing the correlation between the ink temperature and the driving voltage and the types of materials to be recorded.

DETAILED DESCRIPTION OF THE PREFERRED EMBODIMENTS

A detailed description of one preferred embodiment of an ink jet output apparatus embodying the present invention will now be given referring to the accompanying drawings.

Figure 1:
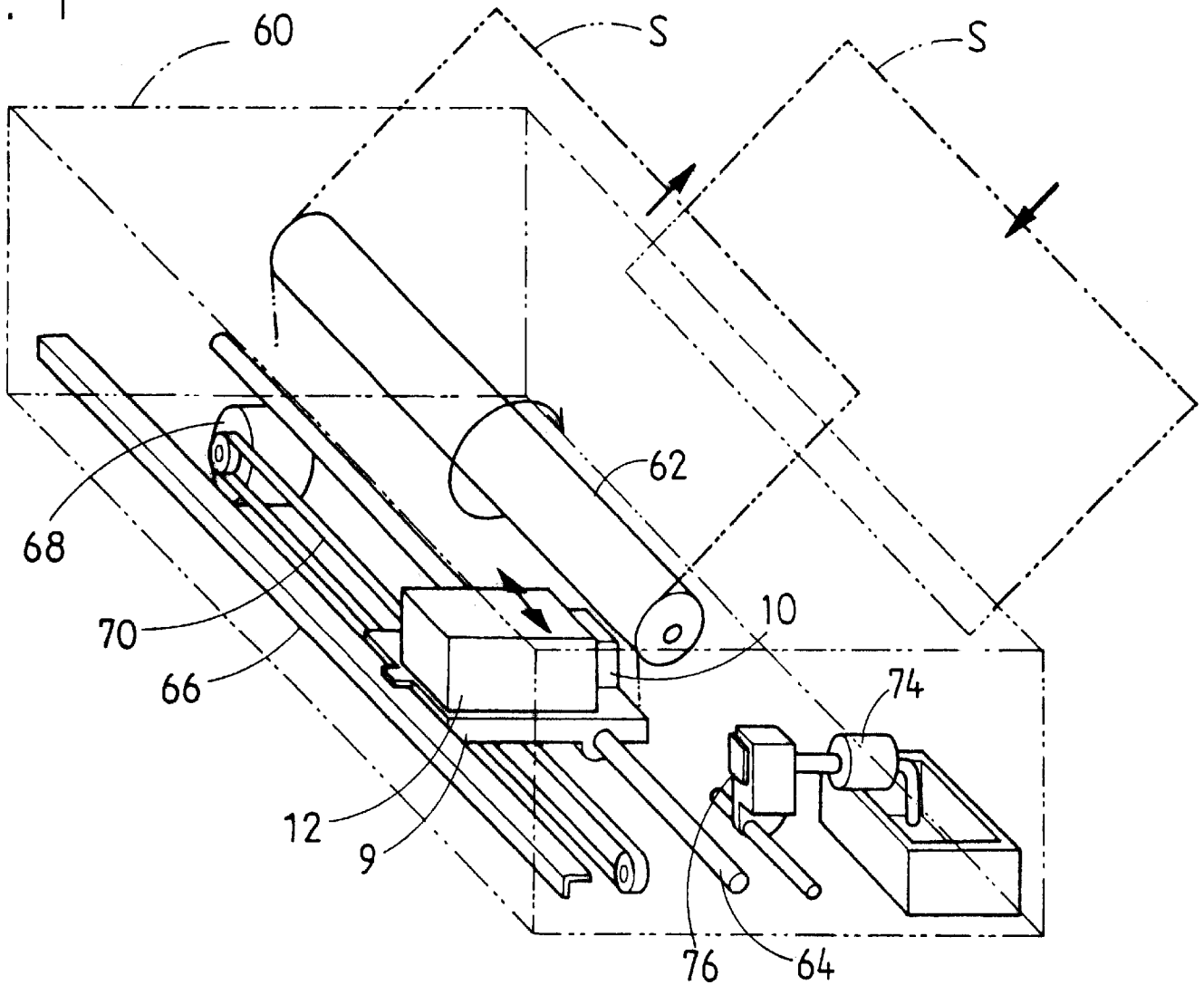
FIG. 1 is a schematic perspective view showing a construction of an ink jet output apparatus in the present embodiment.

FIG. 1 is a schematic perspective view of the ink jet output apparatus in the present embodiment. This ink jet output apparatus has a casing 60 in which a cylindrical platen roller 62 for feeding a print medium S is mounted so as to be axially rotatable. In parallel to the platen roller 62, a guide rod 64 and a guide rail 66 are arranged for supporting a carriage 9 thereon movably in parallel to the platen roller 62. On the carriage 9 are mounted an ink jet head 10 which is a multi-channel piezoelectric type ink jet head for ejecting ink and an ink tank 12 for supplying ink to the ink jet head 10. The carriage 9 will be driven through a belt 70 by a CR motor 68 arranged under the casing 60. In the casing 60, a purge pump 74 and a purge cap 76 are arranged in order to recover the ink ejection state of the ink jet head 10 in case of causing an ejection error.

Figure 2:
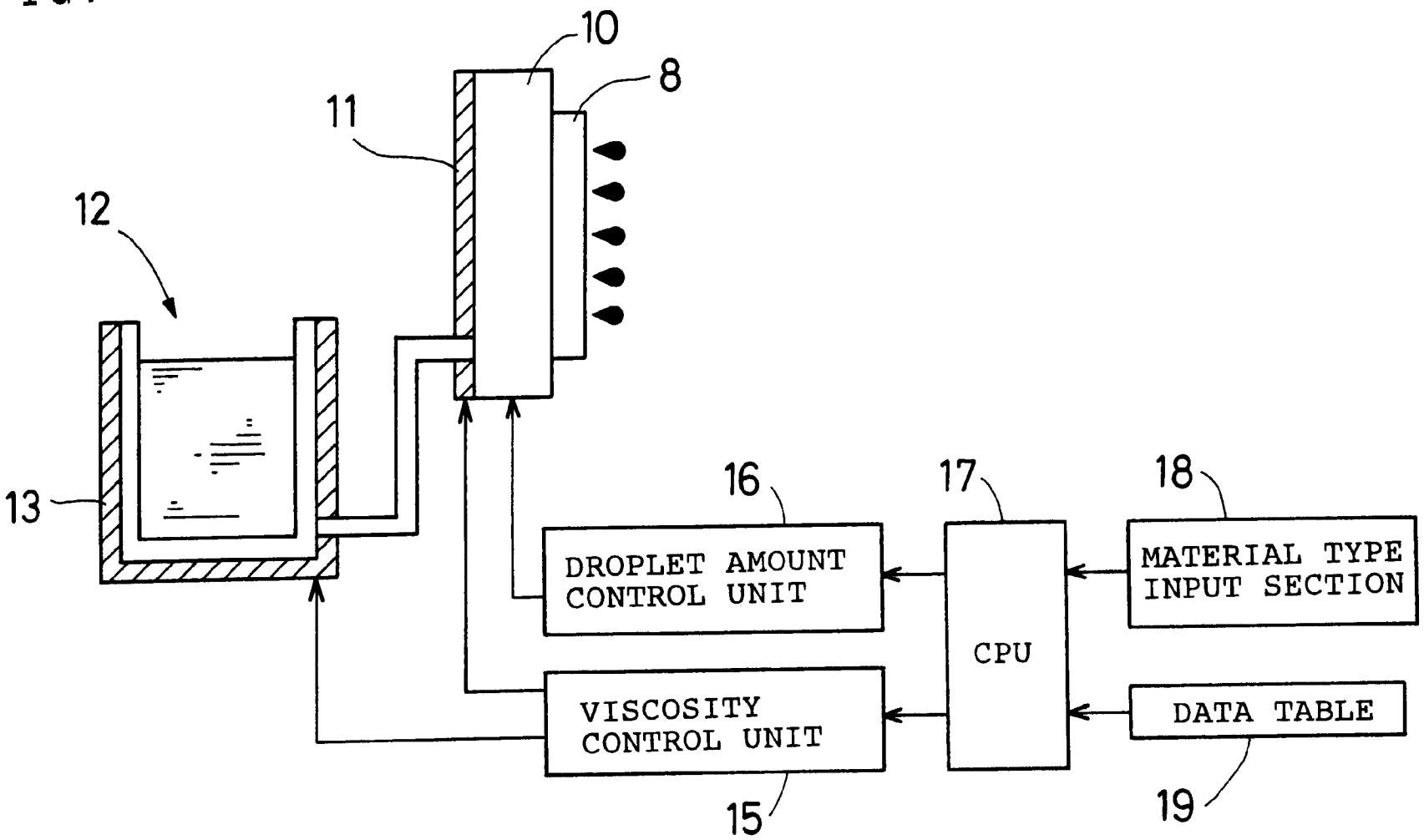
FIG. 2 is a schematic diagram of a control system in the ink jet output apparatus.

As shown in FIG. 2, the ink jet head 10 and the ink tank 13 have electric heaters 11 and 12 respectively, which are for heating the ink existing in the ink jet head 10 and the ink tank 12, thereby controlling each temperature of the ink, to regulate the viscosity of the ink. The ink jet head 10 is provided with a nozzle unit 8 having a plurality of nozzle orifices at the end portion. The electric heater 11 of the ink jet head 10 is disposed so as to heat the ink in the nozzle unit 8.

For a control system of the above components, provided are a viscosity control system 15 for controlling ink viscosity, a droplet amount control system 16 for controlling the amount of an ink droplet to be ejected from each nozzle orifice of the nozzle unit 8, a CPU 17 for controlling the systems 15 and 16, a material type input system 18 to input the type of the print medium S, and a data table 19 wherein optimum values of ink viscosity and ink droplet amount according to the types of print media S.

The viscosity control system 15 is to control the electric heaters 11 and 13 to heat ink, thereby regulating the viscosity of the ink. The droplet amount control system 16 is to control driving voltage of the piezoelectric element to be inputted to the ink jet head 10, thereby regulating a droplet amount per one ink ejection operation. The material type input system 18 is a RAM for setting a type of a print medium S, such as a coated paper for ink jet output apparatus, a copy paper, a tracing paper, an OHP sheet, and various clothes, and the like, in which the input operation is performed by a key operation with a switch panel by an operator. The data table 19 is a ROM which, as shown in FIG. 3 showing a table 1, stores the ink temperature according to the types of print media S, representing the ink viscosity, and the driving voltage of the piezoelectric element, representing the ink droplet amount.

In general, as an ink temperature becomes higher, the viscosity of the ink decreases, so that such an ink is largely blurred on the print medium S. In case of the print medium S having high ink absorbency and easily causing ink blur, therefore, it is required to eject the ink regulated at a low temperature. For instance, cloth has considerably higher ink absorbency as compared to paper, easily causing blur with ink; accordingly, the ink is regulated to have a low temperature, resulting in increased viscosity, and a reduced amount of an ink droplet. If using paper, similarly, the temperature and the ink droplet amount are set to optimum values according to differences in types of papers, makers thereof, and the like.

A film sheet such as an OHP sheet, different from cloth, has little ink absorbency, causing problems of ink bulge, i.e., ink becoming thick like a dome, at an ink adhered portion, which is hard to dry. To prevent those problems, the ink should be regulated to have an increased temperature, resulting in having decreased viscosity, and an increased amount of an ink droplet. This is because the ink bulge at an ink adhered portion causes the OHP sheet to grow dark at the time of OHP projection due to the thickness of the ink, and also as the viscosity of ink becomes higher, the ink will be hard to dry. In addition, increasing the amount of an ink droplet is performed in order to offset a reduced dot size of ink due to a low absorbency of the print medium and thereby to maintain a covering rate.

The ink droplet amount is influenced by not only the driving voltage of the piezoelectric element but also the ink viscosity. It is therefore desired to determine the driving voltage of the piezoelectric element while considering at what temperature the ink being controlled. The ink temperature slightly decreases due to heat radiation during the period from the ink ejection from the nozzle orifices to the ink adhering on a print medium S. Accordingly, the ink temperature is desired to be set taking the decreased temperature into account so that the ink droplet has the optimum viscosity at the time of adhering onto the print medium S.

The data in the table 1 of FIG. 3 are the most suitable values of temperature and droplet amount, which have been obtained as a result of experiments on various print media S at various temperatures and ink droplet amounts. In the table 1, for print media S such as cloth having high absorbency, the temperature of ink is set to be low in order to perform the ejection of the ink with high viscosity of about 80 cP (about 1–20 cP in case of paper) to prevent ink blur.

The table 1 shows the data set for a hot melt ink as a kind of ink; therefore, if using a different ink, a corresponding table like the table 1 according to the kind of the ink. For instance, a liquid ink has little problem of ink becoming thick like a dome at an adhering portion on an OHP sheet as compared with the hot melt ink, whereas it tends to have relatively lower drying speed on the OHP sheet. In an ink jet output apparatus for multicolor print, even if inks have similar colors, the inks have different characteristics according to colors.

Operation of the ink jet output apparatus constructed above will be described hereinafter.

In the ink jet output apparatus, after a print medium S is set, the type of the print medium S is input with the material type input system 18. This input operation is performed by a key operation on a switch panel by an operator, thereby storing the type of the print medium S in the material type input system 18. CPU 17 reads out the ink temperature corresponding to the type of the print medium S stored in the material type input system 18 from the data table 19, and applies a command to the viscosity control system 15. The viscosity control system 15 drives the electric heaters 11 and 13 to heat the inks in the ink jet head 10 (the nozzle unit 8) and the ink tank 12 respectively while controlling the electric heaters 11 and 13 to maintain the temperature of the inks at a commanded value. The inks are thus regulated to have a suitable viscosity for the type of the print medium S input in advance.

In performing print recording, the platen roller 62 feeds the print medium S, and the carriage 9 and the piezoelectric element of the ink jet head 10 are driven and controlled in accordance with a command signal transmitted from a host computer such as a personal computer and the like, thus recording characters, marks, and figures, and the like on the print medium S. In detail, the print medium S supplied from a paper cassette tray and the like is fed and stopped at a position where a line to be printed is facing the ink jet head 10. The carriage 9 is driven by the CR motor 68 at a predetermined print speed to slid within an area facing the print medium S set on the platen roller 62.

The CPU 17 reads out a driving voltage corresponding to the type of the print medium S stored in the material type input system 18 from the data table 19 (Table 1), and provides a command signal to the droplet amount control system 16. The droplet amount control system 16 applies a voltage corresponding to the command signal to the piezoelectric element of the ink jet head 10 in accordance with the print data supplied from a host computer. The ink jet head 10 therefore ejects ink at an amount suitable for the type of the print medium S, from the nozzle unit 8 in accordance with print data. The ejected ink droplets adhere on the print medium S, forming ink prints in accordance with print data on the print medium S and thus completing the print operation.

At this time, both the ink temperature and the amount of an ink droplet are set to be suitable values for the type of the print medium S, so that even if the print medium S is a material having high absorbency such as cloth, the ink ejected onto the print medium S will not be blurred excessively. Alternatively, even if the print medium S is a film sheet such as OHP sheet, the ink ejected thereon will not become thick like a dome on the OHP sheet, preventing problems of having inferior coloring at the time of OHP projection or inferior drying speed. It is consequently to possible to obtain high recording quality without regard to the types of the print media S listed in the Table 1.

With the movement of the carriage 9, successively, the printing operation is performed in accordance with print data. Upon completion of the print operation on that line, the driving of the carriage 9 is stopped there, stopping the printing operation at the same time. Then, when the platen roller 62 is driven to feed the print medium S by an amount of one line, the following print data are printed on that line.

After completion of the print operation of all lines on the print medium S, the carriage 9 is moved outside the area facing the platen 62 and stopped at a position facing the purge cap 76. At the same time, the platen roller 62 is driven to feed the print medium S out of the ink jet output apparatus. The print operation is completed accordingly.

As described above, the ink jet output apparatus in the present embodiment stores in advance data on ink temperature and driving voltage of the piezoelectric element both suitable for the type of the print medium in the data table 19, and performs print operation by ejecting the ink with the ink temperature and the driving voltage according to the type of the print medium S stored in the material input system 18. This makes it possible to prevent deterioration in the print quality caused by an exceeding ink blur and insufficient density of ink print.

Specifically, the data table 19 is also provided with the data concerning print media S such as clothes having a high absorbency so that the print operation on the cloth is performed at a low ink temperature, high ink viscosity, and a little ink droplet amount. The ink jet output apparatus can also perform print operation with high print quality on clothes. The data as to a film sheet such as an OHP sheet is further added in the data table 19 to perform print operation at a low ink viscosity and a larger amount of an ink droplet, thus making it possible to perform print operation with high quality on the OHP sheet.

The ink jet output apparatus has, particularly, a large effect in a case of application to an apparatus for multicolor print. In detail, the ink jet output apparatus is provided with the ink jet heads 10 and the ink tanks 12 for four colors, for example, and the data table 19 according to each color, in which the print operation is controlled using the inks regulated per color to have a viscosity and at an ink droplet amount suitable for the print medium S. A print result with high quality can be obtained without regard to the types of the print media and colors of inks. It is accordingly to provide a beautiful multicolor print on a material such as a cloth, for instance, instead of embroidery.

The present invention may be embodied in other specific forms without departing from the spirit or essential characteristics thereof. For instance, the type of the print medium S is inputted by a manual operation by an operator in the above embodiment, alternatively, a sensor may be used to detect the type of the print medium S and automatically input it.

In the above embodiment, controlling to change ink temperature according to the type of the print medium S regulates the viscosity of the ink, and, instead thereof, the regulation of the viscosity may be performed by changing a space between the nozzle orifices and the print medium S, i.e., a head cap according to the type of the print medium S. In this case, the temperature of the ink under heating with the electric heaters 11 and 13 is constant regardless of the type of the print medium S, and a small head cap is used for a print medium S such as an OHP sheet to eject the ink with a high temperature (low viscosity) thereon, whereas a large head cap is used for a print medium S such as a cloth to radiate heat and eject the ink at a reduced temperature (high viscosity) thereon.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated.

It is intended that the scope of the invention be defined by the claims appended hereto, and their equivalents.

What is claimed is:

1. An ink jet output apparatus for performing recording operation by ejecting ink from a nozzle section onto various types of recording materials, the apparatus comprising:

input means for setting a type of the recording material;

memory means for storing an optimum viscosity and an optimum droplet amount of the ink ejected onto the recording material according to types of materials;

control means for regulating the viscosity of the ink in the nozzle section, the ink being ejected onto the recording material into the optimum viscosity stored in said memory means in accordance with the material type set by said material type input means; and regulation means for regulating an amount of the ink droplet ejected in accordance with the material type set by said material type input means into the optimum droplet amount stored in said memory means.

2. An ink jet output apparatus according to claim 1, wherein said viscosity control means regulates the viscosity of the ink into the optimum viscosity higher than that in a case of regular paper including a coated paper, a copy paper and a tracing paper when the type of material set by in the material type input means is cloth.

3. An ink jet output apparatus according to claim 1, wherein said viscosity control means regulates the viscosity of the ink into the optimum viscosity lower than that in a case of regular paper including a coated paper, a copy paper and a tracing paper when the type of material set by the material type input means is OHP sheet.

4. An ink jet output apparatus according to claim 1, wherein said viscosity control means comprises means for heating the ink and controls the heating means to change a temperature of the ink in accordance with the type of material set by said material type input means, thereby to regulate the viscosity of the ink into the optimum viscosity.

5. An ink jet output apparatus according to claim 4, wherein said heating means causes a change in temperature of the ink at least existing in the nozzle section.

6. An ink jet output apparatus according to claim 1, wherein said droplet amount regulation means regulates the amount of the ink droplet into the optimum droplet amount less than that in a case of regular paper including a coated paper, a copy paper and a tracing paper when the type of material set by the material type input means is cloth.

7. An ink jet output apparatus according to claim 1, wherein said droplet amount regulation means regulates the amount of the ink droplet into the optimum droplet amount larger than that in a case of regular paper including a coated paper, a copy paper and a tracing paper when the type of material input by said material type input means is OHP sheet.

8. An ink jet output apparatus according to claim 1, further comprising a head unit having an ink chamber being filled with ink and communicated with said nozzle section; and an energy generation element for applying ejection pressure to the ink in the ink chamber in response to a driving pulse applied thereto;

wherein said droplet amount regulation means regulates the amount of the ink droplet into the optimum amount by changing the driving pulse applied to said energy generating element.

9. An ink jet output apparatus according to claim 8, wherein said droplet amount regulation means regulates the amount of the ink droplet into the optimum amount by changing a voltage value of the driving pulse.

10. An ink jet output apparatus according to claim 4, wherein said viscosity control means regulates the viscosity of the ink into the optimum viscosity by heating the ink through the heating means so that the temperature thereof is retained at a temperature range of 80–100° C., when the type of material set by the material type input means is the cloth.

11. An ink jet output apparatus according to claim 10, wherein the optimum viscosity lies near 80 cP when the temperature is retained at the temperature range of 80–100° C.

12. An ink jet output apparatus according to claim 4, wherein said viscosity control means regulates the viscosity of the ink into the optimum viscosity by heating the ink through the heating means so that the temperature thereof is retained at a temperature higher than 150° C., when the type of material set by the material type input means is the OHP sheet.

13. An ink jet output apparatus according to claim 12, wherein the optimum viscosity lies within a range of 1–20 cP when the temperature is retained at the temperature higher than 150° C.

14. An ink jet output apparatus according to claim 9, wherein the amount of the ink droplet becomes the optimum amount when the voltage value of the driving pulse is regulated so as to exceed 130 V, in case that the type of material input by the material type input means is cloth.

15. An ink jet output apparatus according to claim 9, wherein the amount of the ink droplet becomes the optimum amount when the voltage value of the driving pulse is regulated so as to lie near 20 V, in case that the type of material input by the material type input means is OHP sheet.

16. An ink jet output apparatus according to claim 1, wherein the droplet amount regulation means regulates an ink amount per one ink droplet into the optimum amount.

* * * * *